US006129778A

United States Patent [19]

Garnier et al.

[11] Patent Number: 6,129,778

[45] Date of Patent: Oct. 10, 2000

[54] PROCESS FOR SUPPLYING A CONSUMPTION UNIT WITH GAS AT SEVERAL PRESSURES

[75] Inventors: Emmanuel Garnier, Paris; Didier Magnet, Vincennes, both of France

[73] Assignee: L'Air Liquide, Paris, Cedex, France

[21] Appl. No.: 09/034,384

[22] Filed: Mar. 4, 1998

Related U.S. Application Data

[60] Provisional application No. 60/048,969, Jun. 6, 1997.

[30] Foreign Application Priority Data

Mar. 4, 1997 [FR] France ..... 97 02559

[51] Int. Cl.[7] ..... C21C 5/30

[52] U.S. Cl. ..... 75/548

[58] Field of Search ..... 75/419, 548, 551, 75/553, 556

[56] References Cited

U.S. PATENT DOCUMENTS 5,538,534 7/1996 Guillard et al. ..... 75/466
5,851,263 12/1998 Bernet et al. ..... 75/10.41
5,882,373 3/1999 Guillard et al. ..... 75/10.12

FOREIGN PATENT DOCUMENTS 2 344 369 10/1977 France .
22 47 012 12/1973 Germany .
24 23 002 12/1974 Germany .
39 15 247 11/1990 Germany .

*Primary Examiner*—Jill Warden
*Assistant Examiner*—Tima McGuthry-Banks
*Attorney, Agent, or Firm*—Young & Thompson

[57] ABSTRACT

In a process for supplying unit (9) that consumes a gas at several pressures, the gas is produced at the highest pressure and is sent to the unit. When the consumption of the unit falls, at least one portion of the high pressure gas is stored in an accumulator (5).

6 Claims, 2 Drawing Sheets

PROCESS FOR SUPPLYING A CONSUMPTION UNIT WITH GAS AT SEVERAL PRESSURES

This application claims the benefit of U.S. Provisional Application Ser. No. 60/048,969, filed Jun. 6, 1997.

The present invention relates to a process and an installation of a unit that consumes a gas at several pressures. In particular, it relates to a process for supplying a steel plant that consumes oxygen at two pressures.

Electrical steel plants are supplied with oxygen either by vaporization of liquid oxygen or by an apparatus for the separation of air in situ. The consumption of oxygen is periodic. The oxygen produced is compressed to a pressure substantially greater than the utilization pressure, for example it is compressed to 30 bars whilst the utilization pressure is of the order of 12 bars. This high pressure oxygen is stored in accumulators which empty when the consumption increases and are replenished when the consumption decreases. The apparatus for air separation produces substantially continuously the average consumption of a steel furnace cycle.

The mean total oxygen consumption (namely the consumption of the burners, the refining lances and as the case may be the nozzles and post-combustion) is more often greater (or sometimes slightly lower than) the instantaneous consumption in the refining lances. Even in the case in which the mean consumption is lower than the instantaneous consumption, the apparatus should be, if it is economically justifiable, slightly over-dimensioned so as to be able itself to use the concepts which are the object of this patent application. This effect is particularly notable when there is a post-combustion step.

On the other hand, the minimum pressure specified nowadays for the assembly needing oxygen is in fact dictated by the need of the refining lances. The inlet pressure of the lance is generally of the order of 12 to 15 bars. The burners (including any injectors for post-combustion) can be supplied with oxygen at a lower pressure (of the order of 5 bars or even less). (The injectors are sometimes burners, which are also in this case used for post-combustion).

One of the objects of the invention is to supply a unit that consumes a gas by reducing the energy needs connected with the supply.

Another object of the invention is to limit the maximum pressure of oxygen stored by the supply installation, thereby reducing the capital costs of this latter.

According to one object of the invention, there is provided a process for the supply of a unit consuming a gas at several pressures, comprising a high pressure and a low pressure, in which the gas is produced at high pressure and sent to the consuming unit.

According to other aspects of the invention, there is provided a process

- in which a portion of the gas at high pressure is stored in an accumulator at a pressure which varies between the high and low pressures
- in which said portion of the gas at high pressure is stored in the accumulator when the demand for high pressure gas is reduced or ends
- in which the unit is a steel plant that consumes oxygen at several pressures
- in which the high pressure is that for supplying the refining lances (and if desired the nozzles) of a steel plant and/or the low pressure is that of the burners of a steel plant
- in which the gas is an air gas produced at high pressure by a separation apparatus constituted by a cryogenic distillation apparatus or a separation apparatus by adsorption

- in which the gas requirements are completed by a vaporized liquid from a source other than the separation apparatus when the needs for gas are greater than the maximum production of the separation apparatus.

According to another object of the invention, there is provided

- an installation of a unit consuming a gas at several pressures comprising a high pressure and a low pressure
- means to supply a first portion of the gas to the high pressure unit
- means to store a second portion of the gas at a pressure between the high pressure and the low pressure in a reservoir
- means to send gas from the reservoir to the unit According to other aspects of the invention, there is provided

- an installation comprising an apparatus for the production of gas connected to the unit and to the reservoir
- an installation comprising means to supply the gas from a source other than the production of the apparatus of the unit.

The invention will now be described with reference to the drawings, in which.

Figure 1:
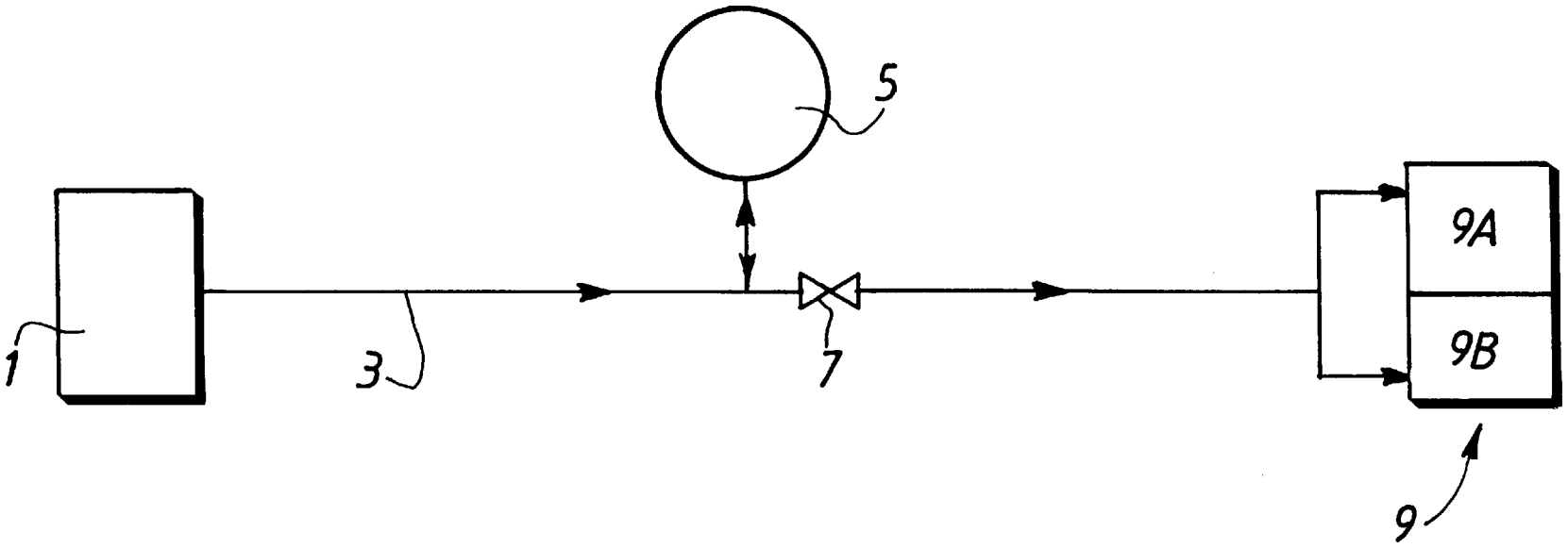
FIG. 1 shows a schematic view of procedure according to the prior art.

In FIG. 1, an air separation apparatus 1 generates a flow (3) of oxygen at 30 bars. This oxygen is expanded to 13 bars and sent to an electric arc furnace (9), a portion being sent to the burners (9A) and the other portion being sent to the refining lances (9B).

When the consumption of the furnace (9) falls, at least a portion of the oxygen is stored at 30 bars in an accumulator (5).

Figure 2:
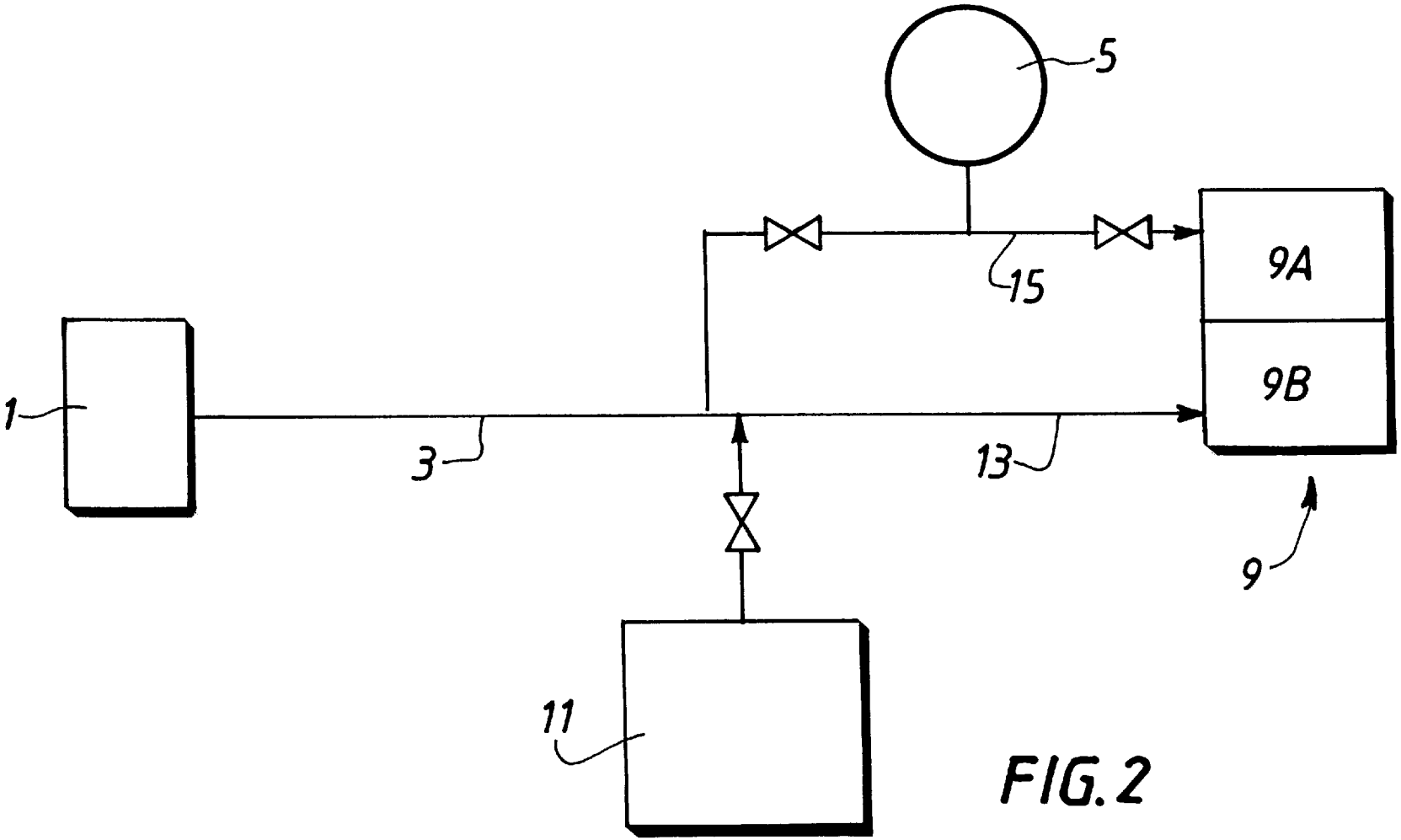
FIG. 2 shows a schematic diagram of a process according to the invention.

In FIG. 2, the oxygen is supplied at 15 bars by the air separation apparatus (1) which can be an apparatus of the VSA type or an apparatus for cryogenic distillation. The oxygen could also be produced by vaporization of liquid under pressure ina suitable device (11).

The gaseous oxygen (3) at 15 bars is directed with priority toward the refining lances (9B) of an electric arc furnace (9), when these latter consume oxygen. An accumulator (5) is installed in the supply circuit of the other consumers of the furnace (9), particularly the burners (9A). The reservoir maintains the oxygen pressure above the minimum usable by the elements (5 to 15 bars) when the production of oxygen is diverted to the lances. When the lances no longer consume oxygen, the accumulator (5) and the other consuming elements of the furnace (burners (9A), etc . . . ) if they consume, are supplied by supplemental oxygen.

As oxygen is compressed only to the maximum used by the furnace, the energy consumption is reduced relative to that of the prior art.

The capital cost of a compressor that compresses oxygen to 30 bars is substantially greater than that of a compressor compressing to 12–15 bars. The overall capital cost will therefore be less. Moreover, the compressors compressing to 12–15 bars are standard and have shorter delivery times than those compressing to 30 bars.

What is claimed is:

1. A process for supplying gas to a gas consuming unit at least at two different pressures, including a first pressure and a second pressure lower than the first pressure, the unit consuming a variable amount of the gas of a given concentration at the first pressure and an amount of the gas at the second pressure, the process comprising the steps of:

producing the gas at a single pressure that is the first pressure;

dividing the gas at the first pressure into at least two parts and providing a first of the parts to the unit at the first pressure and storing a second of the parts at a pressure between the first pressure and the second pressure; and providing the stored gas to the unit at the second pressure.

2. The process of claim 1, wherein when the unit decreases consumption of the gas at the first pressure, the amount of the gas in the second part increases.

3. The process of claim 1, wherein the unit is a steel producing facility.

4. The process of claim 3, wherein the high pressure is a supply pressure of refining lances of the facility and the low pressure is a burner pressure.

5. The process of claim 1, wherein the step of producing the gas comprises the step of separating the gas in one of a cryogenic distillation apparatus and an apparatus for separation by adsorption.

6. The process of claim 5, further comprising the step of providing the gas from a source of vaporized liquid when an amount of the separated gas is not sufficient for operation of the unit.

* * * * *